United States Patent [19]

Van Mullekom

[11] 4,372,349

[45] Feb. 8, 1983

[54] METHOD FOR WEAVING WITH A SHUTTLELESS WEAVING MACHINE, AND WEFT PREPARATION DEVICE TO BE USED THEREIN

[75] Inventor: Hubert P. Van Mullekom, Deurne, Netherlands

[73] Assignee: Ruti-Te Strake B.V., Deurne, Netherlands

[21] Appl. No.: 184,111

[22] Filed: Sep. 4, 1980

[30] Foreign Application Priority Data

Sep. 24, 1979 [NL] Netherlands ..... 7907093

[51] Int. Cl.[3] ..... D03D 47/36

[52] U.S. Cl. ..... 139/452; 242/47.12

[58] Field of Search ..... 139/436, 452; 242/47.12

[56] References Cited

U.S. PATENT DOCUMENTS

| | | | |
|---|---|---|---|
| 3,513,882 | 5/1970 | Strauss | 139/452 |
| 3,587,664 | 6/1971 | Van Mullekom | 139/452 |
| 3,674,057 | 7/1972 | Hosono et al. | 139/452 |
| 4,132,370 | 1/1979 | Van Mullekom | 242/47.12 |

FOREIGN PATENT DOCUMENTS

| | | | |
|---|---|---|---|
| 2116845 | 9/1972 | Fed. Rep. of Germany | 139/436 |

*Primary Examiner*—Henry Jaudon

*Attorney, Agent, or Firm*—C. O. Marshall, Jr.

[57] ABSTRACT

Each of a plurality of winding drums has a thread guide which is rotatable at a constant speed relative thereto and is arranged to continuously wind a thread around one end of the drum. Each drum has means for releasing successive groups of the resulting windings for withdrawal from the other end of the drum, each such group of windings having a total length corresponding to a weft length. A means for controlling the apparatus to permit withdrawal of a plurality of wefts in succession from at least one drum comprises a device for blocking the withdrawal from said drum of a group of windings which have been released by said releasing means, and means for rendering said blocking device inoperative whenever a group of windings are to be withdrawn from said drum and operative during withdrawal of windings from a drum other than said drum.

2 Claims, 2 Drawing Figures

Figure 1:
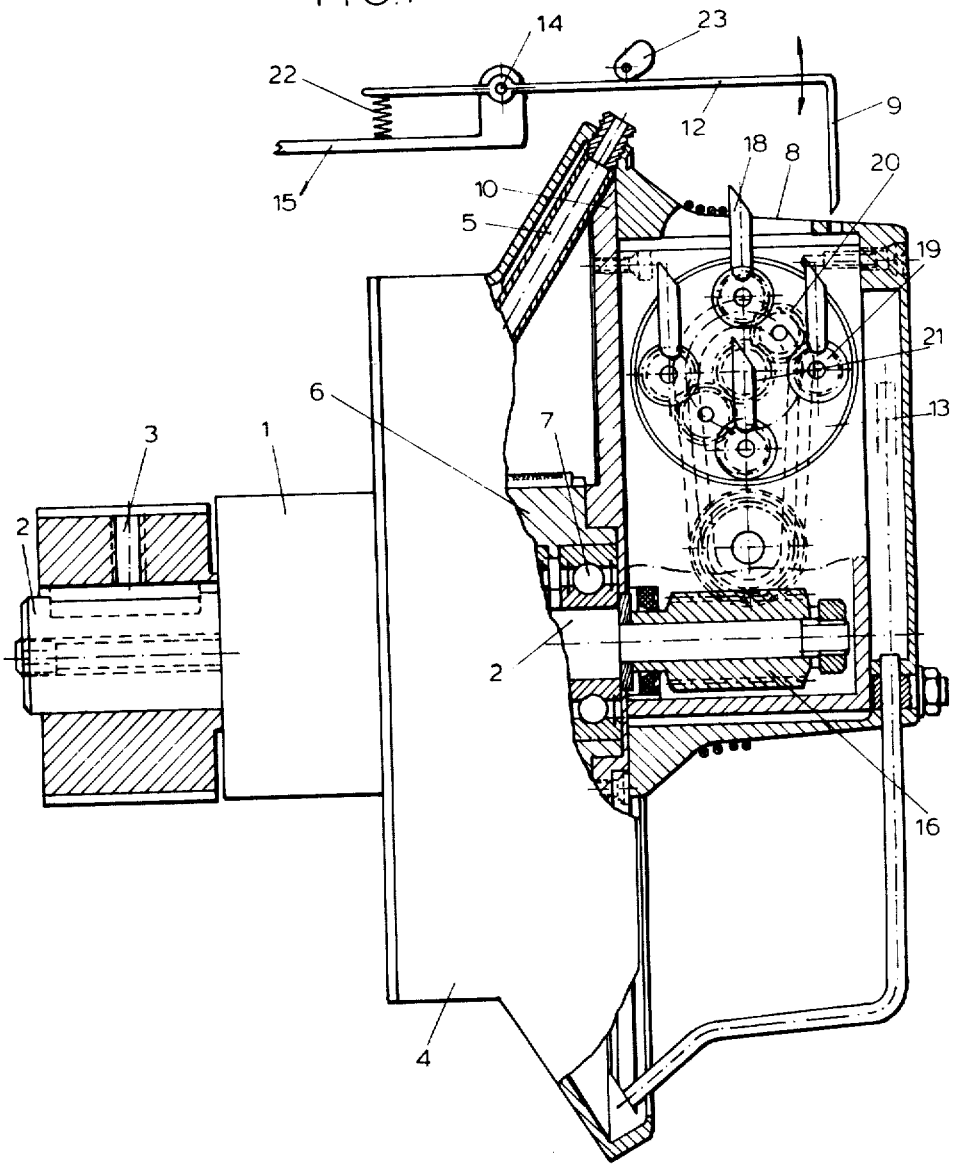

METHOD FOR WEAVING WITH A SHUTTLELESS WEAVING MACHINE, AND WEFT PREPARATION DEVICE TO BE USED THEREIN

The invention relates to a method for weaving with a shuttleless weaving machine making use of two continuously rotating weft preparation devices of the type in which the weft yarn is wound around a storage drum and each time a plurality of yarn windings corresponding to the weft length are separated by mechanical means from the next yarn windings and are released for dispensing to the weft conveyor of the weaving machine, while the numbers of revolutions of both weft preparation devices are selected such that said devices together receive and dispense respectively one weft length of the yarn per weaving cycle.

Such a method is for example applied when the successive weft threads are alternately taken from two different yarn supplies. Each yarn supply then feeds a weft preparation device which is driven with half of the velocity, that is prepares a single weft thread length each two weaving cycles. Therein e.g. a weft preparation device may be used of the type which is described in the Dutch patent application No. 7612811 (=Swiss patent application No. 013837/77; =British application 47974/77; =German application 2751380). Both weft preparation devices therein are operated with such mutual phase displacement that in the moment in which one of both devices has accumulated a number of yarn windings corresponding to the weft length and this weft length is automatically released for supply to an associated weft conveyor, the second device is still in the act of accumulating the number of yarn windings required for the next weft movement.

With similar yarns this is named the "mixing" of the weft yarn originating from different supplies.

According to the invention this known method is adapted to manufacturing a fabric in which a weft of a predetermined yarn type is followed by a (constant) number of wefts of a different yarn type, e.g. in order to obtain a cloth having a reinforced base fabric.

Thereto the method according to the invention is characterized in that the weft preparation devices are controlled such that at least one thereof each time dispenses in at least two successive weaving cycles a weft length of the yarn, the numbers of revolutions of the weft preparation devices having a ratio equal to the numbers of weft length which each of the devices each time dispenses in direct succession, while each preparation device, each time after the automatic release of the accumulated number of yarn windings corresponding to a complete weft length, is blocked up till the next weft movement.

This method offers the advantage that with a given number of weft preparation devices (and associated weft conveyors) fabrics may be manufactured for which in the methods as used up till now a larger number of such devices would be required. Up till now for the manufacture of a cloth having a reinforced base fabric having a 2/1 pattern repeat three weft preparation devices would have to be applied, each being driven at 1/3 of the velocity and two of said devices having to handle the same type of weft yarn; with a cloth having a reinforced base fabric and having a 3/1 pattern repeat four weft preparation devices would be required, each having to be driven at a quarter of the velocity, while three thereof handle the same yarn.

Through the application of the method according to the invention in both cases two weft preparation devices would suffice.

The invention also relates to a weft preparation device which is suitable for application in performing the above described method. This device comprises a winding drum, a thread guide rotatable relative thereto and means displacing the yarn windings, entered onto the drum, in the axial direction towards the dispensing end of the drum and each time separating a number of yarn windings corresponding to the weft length from the next yarn windings and releasing them for dispensing, as is e.g. known from the above mentioned Dutch application No. 7612811. The weft preparation device according to the invention differs from the known construction in that adjacent to the dispensing end of the drum a blocking means is provided which is movable between an operative blocking position and an inoperative position and is controlled in correspondence with the dispensing program associated with the yarn preparation device.

The invention is hereunder further explained with reference to the drawings of an embodiment.

Figure 2:
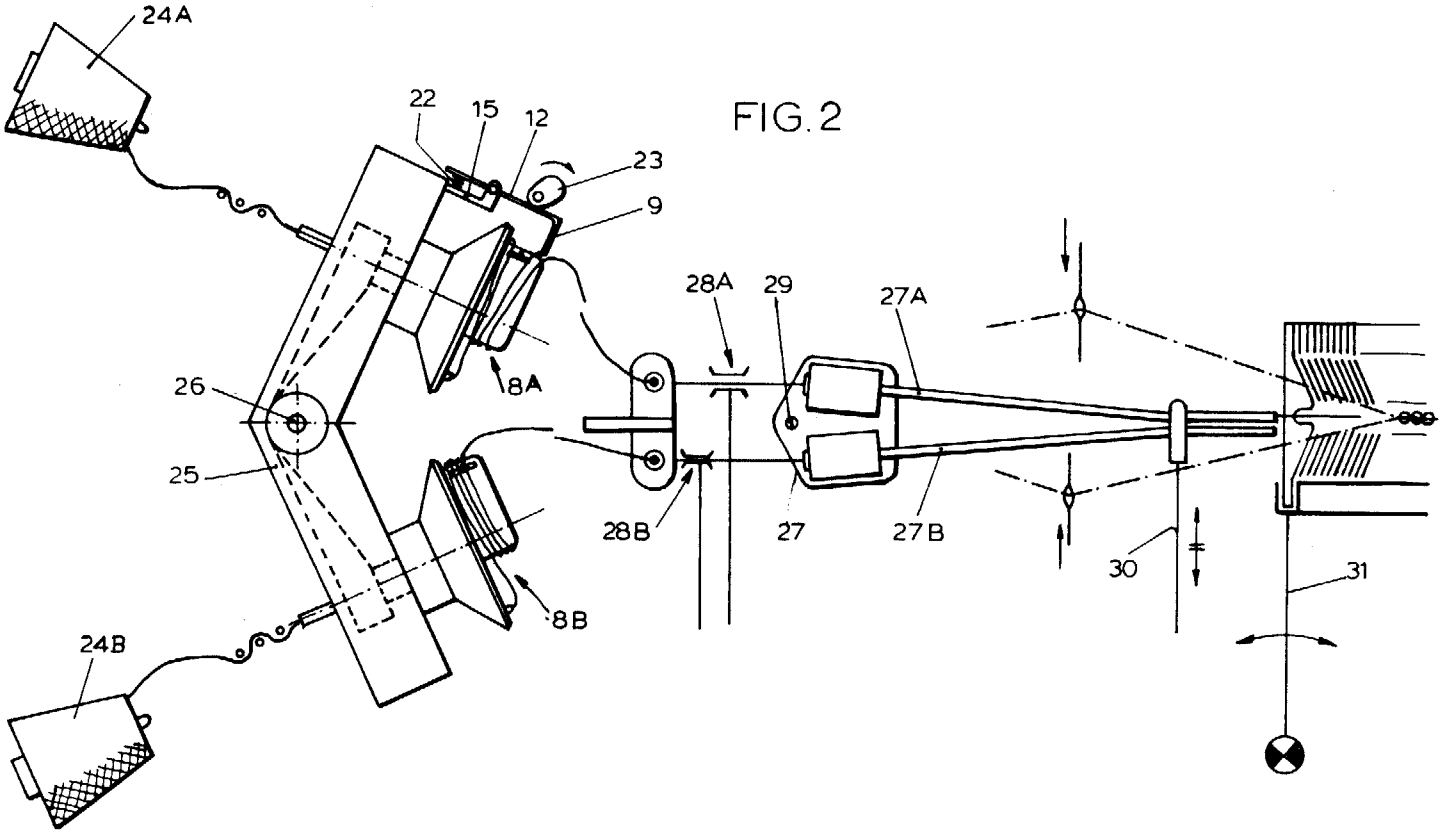

FIG. 1 shows partially in side elevation and partially in longitudinal section the weft preparation device according to the invention, and FIG. 2 shows a schematic elevation of two cooperating weft preparation devices according to the invention, and of double weft conveyor.

The yarn preparation device as shown in FIG. 1 comprises a sleevelike supporting part 1 through the intermediary of which the device may be secured to the frame of a shuttleless weaving machine. A shaft 2 is rotatably journalled in this supporting part 1. The shaft 2 carries at its end projecting outside the supporting part 1, left in FIG. 1, a pulley 3 or a similar transmission member. 4 indicates a housing which is secured to the shaft 2 and therefore is rotatable relative to the stationary supporting part 1 and which supports the winding arm constituted by a tube 5.

6 indicates a cylindrical hub part which through the intermediary of ball bearings 7 is rotatably journalled on the shaft 2 and is coupled with the supporting part 1 through a transmission mechanism, not further shown, within the housing 4, such that it remains stationary when the shaft 2 rotates.

8 indicates the yarn winding drum which is secured against a disc 10 carried by the hub part 6. Through its securing to the hub part 6 the drum 8 remains stationary when the shaft 2 rotates.

A disc 13 is provided within the drum 8, said disc being rotatably mounted around an axis in a plane perpendicular to the shaft 2 and being driven by the shaft 2 through a worm-worm wheel transmission 16 and a belt or chain transmission. The disc 13 has four pins 18 equally spaced around its circumference and extending radially from pinions 19 which are rotatably journalled on the disc 13, said pinions engaging through intermediary gears 20 with a central pinion 21 which is rotatable with such ratio relative to the disc 13 that the pins 18 carry out a translatory movement when the disc 13 rotates. The pins have a substantially radial position relative to the winding drum and enter into operation, that is when the winding arm 5 and the disc 13 rotate, they move successively through an axial slot in the circumferential wall of the drum and extend outside the drum, said slot extending substantially along the upper generatrix of the drum 8, whereby the yarn windings, having been entered by the winding arm 5 onto the winding drum, are moved in axial direction, to the right as seen in the drawing.

Sofar the described weft preparation device is know. A more detailed description is contained in U.S. Pat. No. 4,238,080 FIG. 1 shows the weft yarn preparation device at a moment in which to the left of the upper pin 18 the yarn windings, entered onto the drum by the winding arm 5, are being accumulated, while the yarn windings entered onto the drum in a previous stage, which were lying to the right of the upper pin 18, have already been drawn from the drum to the right. At the moment in which the pin 18, situated farthest to the left, moves, when the disc 13 is rotating, from the space within the drum 8 outwardly, a number of yarn windings having a total length corresponding to that of a weft length, is situated between said pin and the upper pin 18, which then has been moved to the right. Shortly thereafter the pin 18, which was up till now the upper pin, retracts into the space within the drum 8 so that then the yarn windings lying to the right, in front of the then upper pin 18, are released for dispensing. Normally the thus released yarn windings are then carried by a weft conveyor, which may be pneumatic, through the weaving shed of the weaving machine.

According to the invention provisions have been made in order to block the actual dispensing of the released yarn windings during a certain period. In the embodiment shown in the drawing therefore an auxiliary pin 9 has been provided at the discharge end of the drum 8, adjacent to the position where the pins 18 retract from the winding space around the drum into the space within the drum, said auxiliary pin forming part of a two-armed lever 12 mounted to a stationary supporting part 15, rotatable around a shaft 14. The auxiliary pin 9 has a substantially radial position relative to the drum 8 and may enter the inner space of the drum through an aperature in the drum wall, e.g. a slot extending in the circumferential direction. In the embodiment shown the pin 9 is kept in its inoperative position, outside engagement with the drum 8, under the influence of a spring 22. In this position of the auxiliary pin 9 the dispensing of the yarn windings accumulated on the drum may take place unimpeded, as soon as said yarn windings are released for the dispensing. However, by moving the auxiliary pin 9 inwardly, e.g. under the control of a cam 23, against the influence of the spring 22, the dispensing of the released yarn windings may be prevented.

In the arrangement according to FIG. 2 two weft preparation devices, indicated 8A and 8B respectively, are used, said devices being supplied by a yarn supply 24A and a yarn supply 24B respectively. The devices 8A and 8B are mounted in an auxiliary piece 25 carried by the frame of a weaving machine, such that the axes of both devices, as seen in the weft direction, converge. The devices 8A and 8B are driven by a common drive means 26 and each cooperate with a weft conveyor 27A and 27B respectively and with an associated yarn clamp 28A and 28B respectively.

The weft conveyors 27A and 27B are combined into a block 27 which is pivotable through a small angle around an axis 29 between two positions, in which the one weft conveyor or the other is in the operative position. Said pivotal movement takes place controlled by an actuation rod 30 which is reciprocable in the direction of the arrow. A similar double weft conveyor is described in U.S. Pat. No. 4,326,565.

31 indicates the reed of the weaving machine, the contoured reed lamellae of which jointly delimit a conveying channel for the successive weft threads.

In the embodiment shown at least one of the devices 8A, 8B, namely the device 8A, is constructed according to FIG. 1. This means that the device 8A comprises an additional blocking pin 9. FIG. 2 shows a situation in which the weft conveyor 27A is in its operative position, the associated yarn clamp 28A has been opened and the blocking pin 9 of the winding drum 8A has just been moved outwardly through the influence of the spring 22, so that the yarn windings which have been released (already at a previous moment) may be conveyed by the weft conveyor 27A through the weaving shed.

It is assumed that e.g. a fabric is desired having weft cords or being a reinforced base fabric, having a 2/1 pattern repeat. This means that the weft preparation device 8A is driven at a number of revolutions being two thirds of the number of revolutions whereby a single yarn preparation device should be driven, while the number of revolutions of the device 8B must be one third of the normal number of revolutions.

At the moment in view—that is at the start of the weft movement by the conveyor 27A—a number of yarn windings have accumulated on the drum 8B having a total length corresponding to one third of the weft length. After the weft has been inserted by the weft conveyor 27A, and after the yarn clamp 28A has been closed and the beating up movement of the reed and thereby the weaving cycle have been completed, again a weft insertion by the weft conveyor 27A takes place. At that moment, that is at the start of the next weaving cycle, a next number of yarn windings, corresponding to the length of a weft, is released, the blocking pin 9 still being in its inoperative position, and when the yarn clamp 28A is opened, this length is entered by the conveyor 27A in the weaving shed. At the start of said second weft movement by the conveyor 27A in the meantime a number of windings have accumulated on the drum 8B, having a total length equal to two thirds of a weft length. The control of the blocking pin 9 is such that directly after the weft phase during the second weft movement by the conveyor 27A, the blocking pin 9 again resumes its operative blocking position. After the completion of the second weaving cycle, i.e. after again closing the yarn clamp 28A and retracting the reed after the heating up movement thereof, the next weft insertion by the weft conveyor 27B takes place. At the start of the third weaving cycle the number of yarn windings on the drum 8B has namely increased to a length corresponding to that of a complete weft length and this length is released for conveying through the weaving shed by the conveyor 27B. Therefore the weft conveyor 27B has been moved, after the completion of the previous weft phase, under the control of the actuating rod 30, to its operative position, while at the start of the third weaving cycle the yarn clamp 28B is opened. At the start of the third weaving cycle a number of yarn windings has accumulated on the drum 8A, corresponding to two thirds of a weft length. After half of the third weaving cycle has taken place this number of yarn windings will have increased to a complete weft length. At that moment, that is after half the period time of a weaving cycle too early, without the blocking pin 9, the yarn length required for the next weft movement would be released. This release (by the relative gripping pin 18) is, however, prevented by the blocking pin 9, namely up till the start of the fourth weaving cycle. At the start of the fourth weaving cycle the blocking pin 9 again moves outwardly and therefore, after the opening of the yarn clamp 28A, the dispensing of the prepared weft yarn length from the drum 8A may take place in order to carry out the fourth weft movement by the conveyor 27A which in the meantime has returned to its operative position.

It will be clear that when both devices 8A and 8B are provided with a blocking apparatus 9, fabrics may be manufactured having more than one weft threads directly following each other, of both types of weft yarn. In this way a fabric could be obtained having weft cords or a reinforced base fabric with a 3/2 pattern repeat, if the devices 8A and 8B would be provided both with a blocking device and if said devices would be driven with numbers of revolutions which are three fifths and two fifths respectively of the number of revolutions of a single yarn preparation device.

Likewise it is possible to apply more than two yarn preparation devices, jointly preparing a complete weft length per weaving cycle.

I claim:

1. A method of preparing wefts on a plurality of winding drums for withdrawal by a weft conveyor, comprising the steps of continuously winding a separate thread at a constant rate on each drum, and releasing on each drum successive groups of the resulting windings for withdrawal from the drum, each such group of windings having a total length corresponding to a weft length, wherein the improvement comprises the steps of withdrawing by means of a weft conveyor a plurality of such groups in succession from one drum, and then blocking the withdrawal of a group of windings which have been released on said drum while withdrawing a group of windings which have been released on a drum other than said drum.

2. Weft preparation apparatus comprising a plurality of winding drums, each having a thread guide which is rotatable at a constant speed relative thereto and is arranged to continuously wind a thread around one end of the drum, and each having means for releasing successive groups of the resulting windings for withdrawal from the other end of the drum, each such group of windings having a total length corresponding to a weft length, wherein the improvement comprises means for controlling the apparatus to permit withdrawal of a plurality of wefts in succession from at least one drum, comprising a device for blocking the withdrawal from said drum of a group of windings which have been released by said releasing means, and means for rendering said blocking device inoperative whenever a group of windings are to be withdrawn from said drum and operative during withdrawal of windings from a drum other than said drum.

* * * * *